US007963786B1

(12) United States Patent
Su et al.

(10) Patent No.: US 7,963,786 B1
(45) Date of Patent: Jun. 21, 2011

(54) AUDIO JACK

(75) Inventors: Yu-hung Su, Tu Cheng (TW); Yao-ting Wang, Tu Cheng (TW)

(73) Assignee: Cheng Uei Precision Industry Co., Ltd., Tu Cheng, Taipei (TW)

( * ) Notice: Subject to any disclaimer, the term of this patent is extended or adjusted under 35 U.S.C. 154(b) by 0 days.

(21) Appl. No.: 12/954,842

(22) Filed: Nov. 26, 2010

(51) Int. Cl.
*H01R 13/52* (2006.01)

(52) U.S. Cl. ..... 439/271; 439/668

(58) Field of Classification Search ..... 439/668, 439/669, 271, 607.01, 607.02
See application file for complete search history.

(56) References Cited

U.S. PATENT DOCUMENTS 7,445,515 B1 * 11/2008 Yuan et al. ..... 439/668
7,568,929 B1 * 8/2009 Su et al. ..... 439/188

* cited by examiner

*Primary Examiner* — Javaid Nasri
(74) *Attorney, Agent, or Firm* — Cheng-Ju Chiang

(57) ABSTRACT

Provided is an audio jack, including an insulating housing, a plurality of contacts, a waterproof covering body and a retaining shell. The insulating housing disposes an inserting hole and a plurality of contact-receiving grooves. The contacts are separately inserted into the contact-receiving grooves. The waterproof covering body encompasses the insulating housing and is made of elastic material. The waterproof covering body disposes a ring-shaped protruding edge extending out of an end surface of the insulating housing. The retaining shell is mounted on the outside of the waterproof covering body and disposes a plurality of hook portions. The audio jack of the present invention can make the hook portions tightly hook the circuit board and make the protruding edge be tightly pressed on one surface of the circuit board, so that no gap exists between the audio jack and the circuit board and the waterproof function can be obtained.

3 Claims, 2 Drawing Sheets

AUDIO JACK

BACKGROUND OF THE INVENTION

1. Field of the Invention

The present invention relates to a connector, and more particularly to an audio jack.

2. Description of the Prior Art

With the development of science and technology, an audio jack is widely applied to electronic products such as a mobile telephone, a digital camera and so on.

Generally, a traditional audio jack includes an insulating housing and a plurality of contacts contained in the insulating housing. The insulating housing forms a connecting opening, and each of the contacts has a soldering portion extending out of the insulating housing from the connecting opening and being soldered onto a circuit board.

However, the traditional audio jack has not waterproof function, so the moisture can easily enter into the inner of the electronic product to corrode the electric circuit and other electronic components. It is resulted that the electronic product has a bad working quality or cannot work at all.

BRIEF SUMMARY OF THE INVENTION

An object of the present invention is to provide an audio jack, capable of preventing the moisture from entering into the inner thereof.

To achieve the above object, in accordance with the present invention, an audio jack is provided, comprising an insulating housing, a plurality of contacts, a waterproof covering body and a retaining shell. The insulating housing disposes an inserting hole and a plurality of contact-receiving grooves communicated with the inserting hole. The contacts are separately inserted into the contact-receiving grooves and each of contacts includes a connecting portion extending out of the insulating housing. The waterproof covering body encompasses the insulating housing and is made of elastic material. The waterproof covering body disposes a ring-shaped protruding edge extending out of an end surface of the insulating housing. The retaining shell is mounted on the outside of the waterproof covering body and disposes a plurality of hook portions.

Based on the above description, the audio jack of the present invention employs the waterproof covering body to encompass the insulating housing, and disposes the retaining shell on the outside of the waterproof covering body. Moreover, the hook portions of the retaining shell can tightly hook the circuit board to make the protruding edge of the waterproof covering body be tightly pressed on one surface of the circuit board, so that no gap exists between the audio jack and the circuit board and the waterproof function can be obtained.

DETAILED DESCRIPTION OF THE PREFERRED EMBODIMENTS

The following embodiment with reference to the accompanying drawings now has been given for detail describing the technology, the feature, the object and the effect of the present invention.

Figure 1:
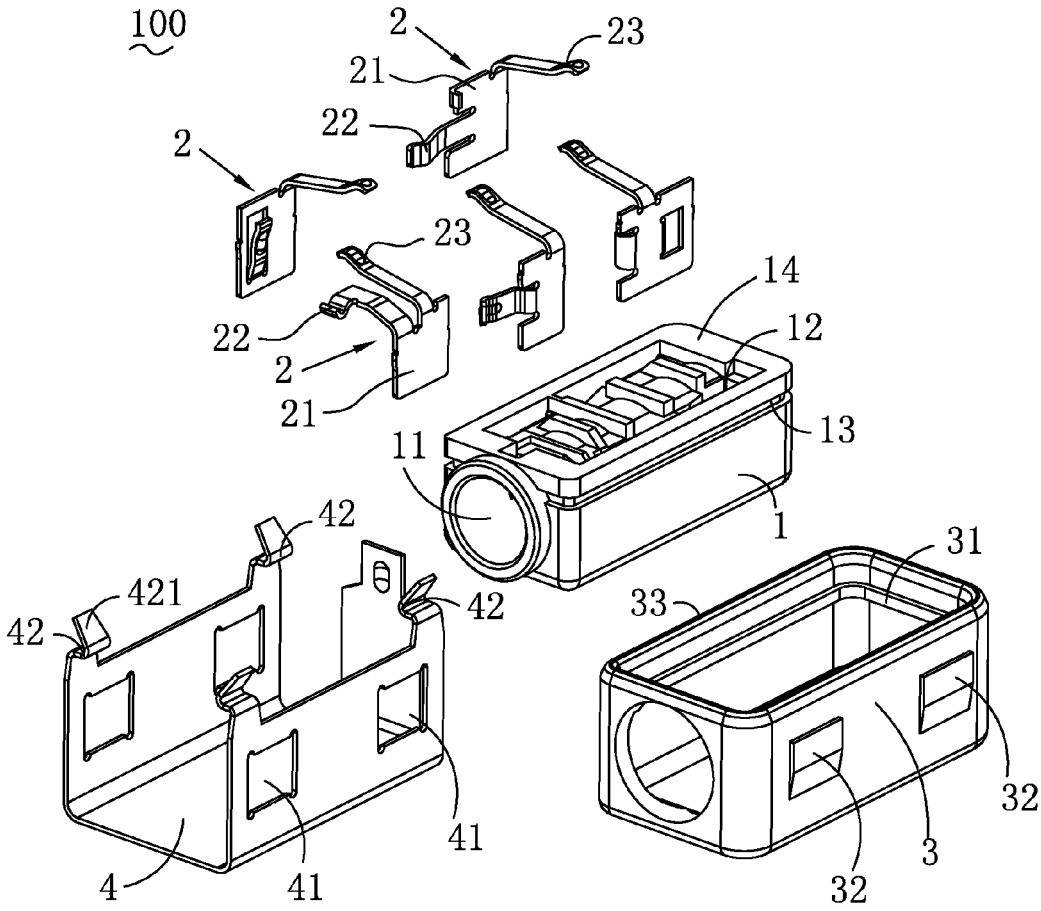
FIG. 1 is an exploded perspective view of an audio jack according to one embodiment of the present invention.

Referring to FIG. 1, an audio jack 100 of the present invention comprises an insulating housing 1, a plurality of contacts 2, a waterproof covering body 3 and a retaining shell 4.

Continuously referring to FIG. 1, the insulating housing 1 is generally rectangular shaped. The insulating housing 1 forms an inserting hole 11, and disposes a plurality of contact-receiving grooves 12 communicated with the inserting hole 11. The insulating housing 1 disposes a groove 13 on the outside thereof.

The contacts 2 are inserted into the contact-receiving grooves 12 of the insulating housing 1. Each contact 2 includes a base portion 21, a contact portion 22 extending from the base portion 21, and a connecting portion 23 extending out of the insulating housing 1 and being soldered onto a circuit board 5.

The waterproof covering body 3 is made of the elastic material having waterproof performance. In one embodiment, the waterproof covering body 3 is made of silica gel having elasticity. The waterproof covering body 3 covers the insulating housing 1 and disposes a waterproof protruding ring 31, which can be contained in the groove 13 of the insulating housing 1 for obtaining a better sealing and waterproof effect. The waterproof covering body 3 disposes a plurality of holding blocks 32 on the outside thereof, and forms a ring-shaped protruding edge 33 extending out of an end surface 14 of the insulating housing 1.

The retaining shell 4 is mounted on the outside of the waterproof covering body 3. The retaining shell 4 disposes a plurality of hook portions 42 and a plurality of holding holes 41 corresponding to the holding blocks 32. Each holding block 32 is held in the corresponding holding hole 41. Each hook portion 42 disposes a guiding inclined surface 421.

The circuit board 5 disposes a plurality of openings 51 separately corresponding to the hook portions 42 of the retaining shell 4.

Figure 2:
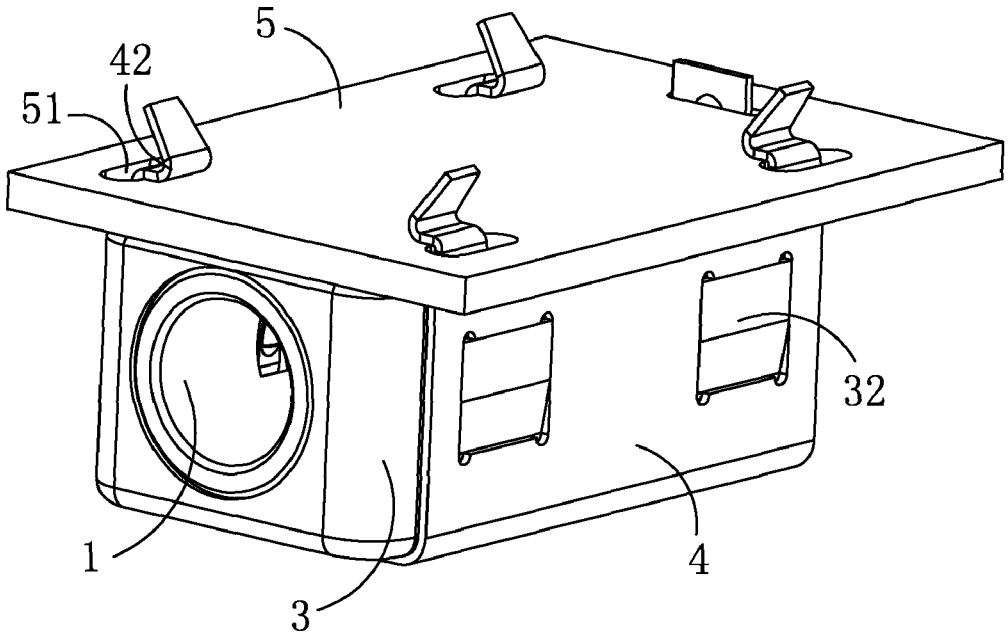
FIG. 2 is a perspective view showing that the audio jack of FIG. 1 is soldered onto a circuit board.

Referring to FIGS. 1 and 2, when the audio jack 100 of the present invention is assembled, the contacts 2 are first inserted into the corresponding contact-receiving groove 12. Then, the waterproof covering body 3 encompasses the insulating housing 1. Next, the retaining shell 4 is mounted on the outside of the waterproof covering body 3. Finally, each hook portion 42 of the retaining shell 4 passes through the corresponding opening 51 of the circuit board 5 to tightly hook the circuit board 5 by the help of the guiding inclined surface 421 thereof. Now, the protruding edge 33 of the waterproof covering body 3 of the audio jack 100 can be tightly pressed on one surface of the circuit board 5, so that no gap exists between the audio jack 100 and the circuit board 5. Whereby the waterproof function can be obtained.

As described above, the audio jack of the present invention employs the waterproof covering body 3 to encompass the insulating housing 1, and disposes the retaining shell 4 on the outside of the waterproof covering body 3. Moreover, the hook portions 42 of the retaining shell 4 can tightly hook the circuit board 5 so that the protruding edge 33 of the waterproof covering body 3 is tightly pressed on one surface of the circuit board 5. Therefore, no gap exists between the audio jack 100 and the circuit board 5, and the waterproof function can be obtained.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An audio jack comprising:

an insulating housing, disposing an inserting hole and a plurality of contact-receiving grooves communicated with the inserting hole;

a plurality of contacts, being separately inserted into the contact-receiving grooves and each of which including a connecting portion extending out of the insulating housing;

a waterproof covering body, encompassing the insulating housing, being made of elastic material and disposing a ring-shaped protruding edge extending out of an end surface of the insulating housing; and a retaining shell, being mounted on the outside of the waterproof covering body and disposing a plurality of hook portions.

2. The audio jack as claimed in claim 1, wherein the insulating housing disposes a groove on the outside thereof; the retaining shell disposes a plurality of holding holes; the waterproof covering body is made of silica gel, and disposes a waterproof protruding ring on the inside thereof and a plurality of holding blocks on the outside thereof; the waterproof protruding ring is contained in the groove of the insulating housing; and the holding blocks are separately held in the holding holes.

3. The audio jack as claimed in claim 1, wherein each of the hook portions of the retaining shell disposes a guiding inclined surface.

* * * * *